US009385430B2

(12) United States Patent
Kushta et al.

(10) Patent No.: US 9,385,430 B2
(45) Date of Patent: Jul. 5, 2016

(54) BROADBAND PATCH ANTENNA

(75) Inventors: Taras Kushta, Tokyo (JP); Takashi Harada, Tokyo (JP)

(73) Assignee: NEC CORPORATION, Tokyo (JP)

( * ) Notice: Subject to any disclaimer, the term of this patent is extended or adjusted under 35 U.S.C. 154(b) by 153 days.

(21) Appl. No.: 14/117,720

(22) PCT Filed: May 16, 2011

(86) PCT No.: PCT/JP2011/002693

§ 371 (c)(1),
(2), (4) Date: Nov. 14, 2013

(87) PCT Pub. No.: WO2012/157016

PCT Pub. Date: Nov. 22, 2012

(65) Prior Publication Data

US 2014/0085147 A1 Mar. 27, 2014

(51) Int. Cl.

*H01Q 1/38* (2006.01)
*H01Q 9/04* (2006.01)
*H01Q 21/06* (2006.01)

(52) U.S. Cl.

CPC ..... *H01Q 9/0414* (2013.01); *H01Q 9/0442* (2013.01); *H01Q 9/0457* (2013.01); *H01Q 21/065* (2013.01)

(58) Field of Classification Search

CPC ..... H01Q 1/38; H01Q 9/0442; H01Q 21/065; H01Q 9/0414
USPC ..... 343/700 MS, 893
See application file for complete search history.

(56) References Cited

U.S. PATENT DOCUMENTS

| | | | | | |
|---|---|---|---|---|---|
| 5,410,323 | A * | 4/1995 | Kuroda | 343/700 MS |
| 5,467,095 | A * | 11/1995 | Rodal et al. | 343/700 MS |
| 6,121,931 | A * | 9/2000 | Levi | 343/700 MS |
| 6,323,810 | B1 * | 11/2001 | Poilasne et al. | 343/700 MS |
| 7,432,862 | B2 | 10/2008 | Heyde | |
| 2007/0024511 | A1 * | 2/2007 | Li et al. | 343/713 |
| 2010/0194643 | A1 | 8/2010 | Petros | |

FOREIGN PATENT DOCUMENTS

| | | | |
|---|---|---|---|
| JP | S63140705 | U | 9/1988 |
| JP | 4-55815 | U | 5/1992 |
| JP | 2000-514614 | A | 10/2000 |
| JP | 2001094338 | A | 4/2001 |
| JP | 2004088136 | A | 3/2004 |
| JP | 2007-20009 | A | 1/2007 |
| JP | 2008-258840 | A | 10/2008 |
| WO | 2008/132785 | A1 | 11/2008 |

OTHER PUBLICATIONS

International Search Report for PCT Application No. PCT/JP2011/002693, mailed on Aug. 16, 2011.
International Preliminary Report on Patentability (IPRP), PCT/IB/373 with PCT/ISA/237 for PCT Application No. PCT/JP2011/002693 issued on Nov. 19, 2013.

(Continued)

*Primary Examiner* — Hoanganh Le

(57) ABSTRACT

An antenna of the present invention includes: a first conductive patch having a rectangular shape with corrugations on two opposing sides; and a second conductive patch below said first conductive patch and connected to a feeding point.

10 Claims, 16 Drawing Sheets

(56) References Cited

OTHER PUBLICATIONS

Japanese Office Action for JP Application No. 2013-552443 mailed on Dec. 17, 2014 with English Translation.

"Antenna Engineering Handbook (2nd Edition)" edited by The Institute of Electronics, Information and Communication Engineers, (Ohmsha, Issued on Jul. 25, 2008). Cited in JPOA.

Japanese Office Action for JP Application No. 2013-552443 mailed on Mar. 24, 2015 with English Translation.

* cited by examiner

BROADBAND PATCH ANTENNA

This application is a National Stage Entry of PCT/JP2011/002693 filed on May 16, 2011, the contents of all of which are incorporated herein by reference, in their entirety.

TECHNICAL FIELD

The present invention relates to broadband antennas for microwave and millimeter wave.

BACKGROUND ART

Antennas are key components in wireless communication systems. To make such systems competitive in the market, miniaturized and cost-effective antennas are necessary. Moreover, bandwidth for the antennas has to be wider to provide a high-speed data transmission by means of the systems. To achieve these targets, patch antennas based on multilayer substrate technologies are one of possible solutions.

In US2010/0194643A1, a wideband patch antenna is described. In this patch antenna a helix-shaped probe is used to provide enlargement of the width of the frequency band.

In U.S. Pat. No. 7,432,862, a broadband patch antenna is presented. The broadband range in this invention is obtained by forming the patch as a cross.

However, cost and electrical performance are main issues for these patch antennas and should be improved.

Thus, it is important to obtain patch antennas which can be cost-effective, compact and can be used in a wide frequency band.

CITATION LIST

Patent Literature

[PTL 1]
US2010/0194643A1
[PTL 2]
U.S. Pat. No. 7,432,862

SUMMARY OF INVENTION

It is an object of the present invention to form a patch antenna using a multilayer substrate technology which can provide a broadband operation of a communication system. Here, such broadband operation is obtained by forming a patch in the multilayer substrate with corrugations at its edges or its sides.

It is another object of this invention to form corrugations at the patch edges or the patch sides in which ridges are in parallel to the longer side of the second rectangular patch disposed under the first conductive patch.

It is another object of this invention to form corrugations at the patch edges or the patch sides in which ridges are perpendicular to the longer side of the second rectangular patch disposed under the first conductive patch.

An antenna of the present invention includes: a first conductive patch having a rectangular shape with corrugations on two opposing sides; a second conductive patch below said first conductive patch and connected to a feeding point; and an isolating material between said first and said second conductive patches.

DESCRIPTION OF EMBODIMENTS

Hereinafter, several types of broadband patch antennas disposed in multi layer substrates according to the present invention will be described in details with reference to attached drawings. But, it would be well understood that this description should not be viewed as narrowing the appended claims.

First Embodiment

Figure 1:
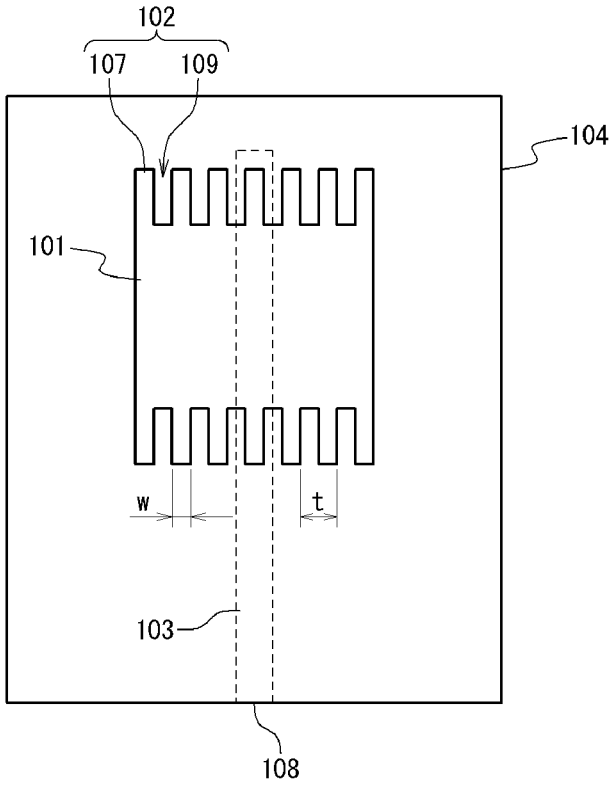
FIG. 1 is a top view of an antenna in which the first patch has corrugations with ridges directed in parallel to the longer side of the second patch.

In FIG. 1, an exemplary embodiment of a broadband patch antenna is shown. In this embodiment, the antenna is formed in a multilayer substrate 104. The multilayer substrate 104 includes a first conductive layer and a second conductive layer. The first conductive layer includes a first conductive patch 101. The second conductive layer includes a second conductive patch 103. The first conductive patch 101 has a rectangular shape with corrugations 102 on two opposing sides. The corrugations 102 include rectangular ridges 107 and rectangular grooves 109. The second conductive patch 103 has a rectangular shape.

The multilayer substrate 104 can further include an isolating material and a third conductive layer, both of which are not shown in FIG. 1. In this case, the third conductive layer can include a ground plane, which is not shown in FIG. 1.

The second conductive layer is disposed below the first conductive layer. Consequently, the second conductive patch 103 is disposed below the first conductive patch 101. One end of the second conductive patch 103 is connected to a feeding point 108.

The isolating material can be disposed between the first and the second patches 101 and 103. The ground plane can be below the first and the second patches 101 and 103, and in this case the isolating material can also be disposed between the second patch 103 and the ground plane.

The corrugations 102 are constructed to enlarge the bandwidth of the antenna.

It should be noted that the direction of the ridges 107 in the corrugation 102 with respect to the orientation of the second conductive patch 103 is a distinguishing and important point of the invention. In the characteristic embodiment shown in FIG. 1, the ridges 107 of the corrugations 102 are directed in parallel to the longer side of the second conductive patch 103. In this case, the electrical field radiated from the second conductive patch 103 is parallel to the ridges 107 of the corrugations 102. As a result, the electromagnetic properties of the corrugations 102 can be approximately described by a one-dimensional inductive grid, for which the impedance, Z(g,ind), can be roughly defined as following:

$$Z(g,\text{ind})=j\cdot Zs(t/\lambda)\cdot\ln(\text{cosec}(\pi\cdot w/2t)) \quad (1)$$

where j is square root of −1, Zs is the characteristic impedance of the isolating material between the first and the second conductive patches 101 and 103, t is the pitch of the corrugations 102, and w is the width of one ridge 107, as shown in FIG. 1.

Thus, the corrugations 102 of the first patch 101, in which ridges 107 are oriented in parallel to the wider side of the second and feeding patch 103, provide an impedance-transforming circuit, which can be used for widening the bandwidth of the patch antenna.

Second Embodiment

Figure 2:
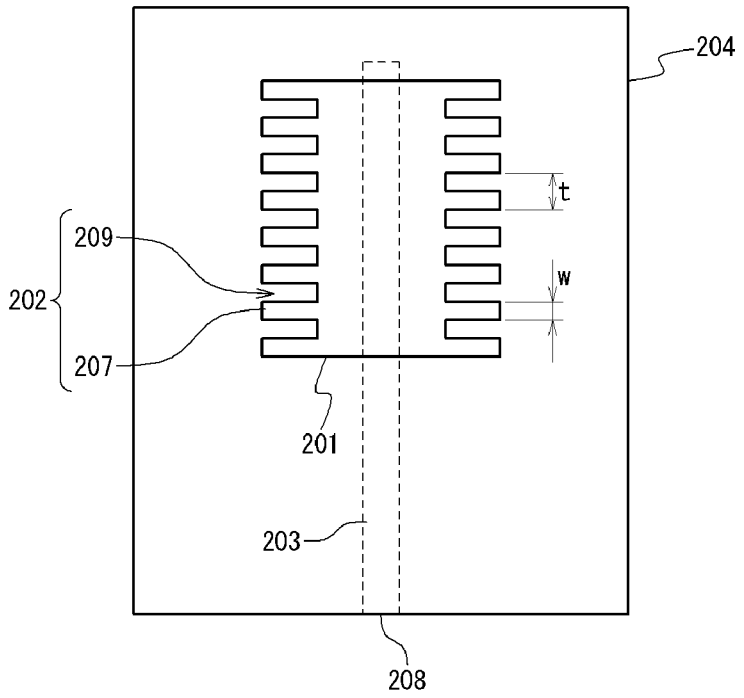
FIG. 2 is a top view of an antenna in which the first patch has corrugations with ridges directed perpendicularly to the longer side of the second patch.

In FIG. 2, another exemplary embodiment of the broadband patch antenna is presented. In this embodiment, the antenna is formed in a multilayer substrate 204. The multilayer substrate 204 includes a first conductive layer and a second conductive layer. The first conductive layer includes a first conductive patch 201. The second conductive layer includes a second conductive patch 203. The first conductive patch 201 has a rectangular shape with corrugations 202 on two opposing sides. The corrugations 202 include rectangular ridges 207 and rectangular grooves 209. The second conductive patch 203 has a rectangular shape.

The multilayer substrate 204 can further include an isolating material and a third conductive layer, both of which are not shown in FIG. 2. In this case, the third conductive layer can include a ground plane, which is not shown in FIG. 2.

The second conductive layer is disposed below the first conductive layer. Consequently, the second conductive patch 203 is disposed below the first conductive patch 201. One end of the second conductive patch 203 is connected to a feeding point 208.

The isolating material can be disposed between the first and the second patches 201 and 203. The ground plane can be below the first and the second patches 201 and 203, and in this case the isolating material can also be disposed between the second patch 203 and the ground plane.

The corrugations 202 are constructed to enlarge the bandwidth of the antenna.

In the characteristic embodiment shown in FIG. 2, the ridges 207 of the corrugations 202 are directed perpendicularly to the longer side of the second conductive patch 203. In this case, the electrical field radiated from the second conductive patch 203 is perpendicular to the ridges 207 of the corrugations 202. As a result, the electromagnetic properties of the corrugations 202 can be approximately described by a one-dimensional capacitive grid, for which the impedance, Z(g,cap), can be roughly written as:

$$Z(g,\text{cap})=-Zs\cdot j/(4\cdot(t/\lambda)\cdot\ln(\text{cosec}(\pi\cdot w/2t))) \quad (2)$$

Therefore, corrugations of a patch in which ridges are oriented perpendicularly to the wider side of the feeding second patch give another impedance-transforming circuit.

(Related Art)

Figure 3:
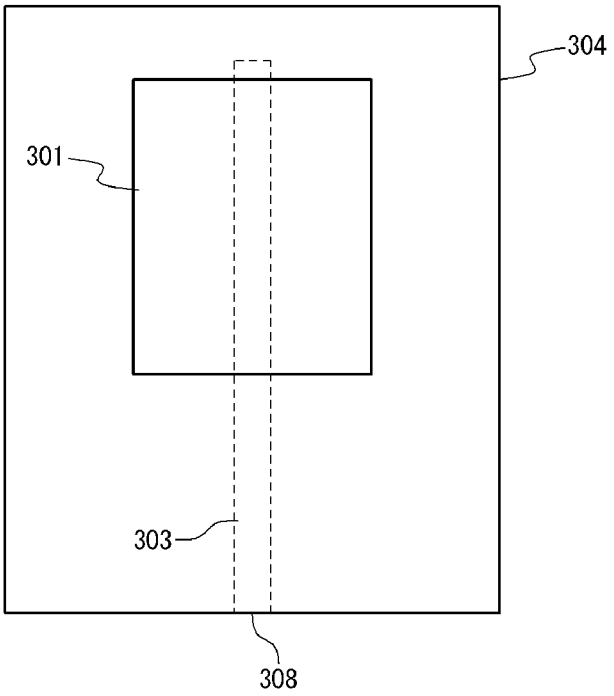
FIG. 3 is a top view of relating art antenna.

In FIG. 3, a construction of a relating art patch antenna is shown. In this construction, a first conductive patch 301 without corrugations and a second conductive patch 303 are formed in a multilayer substrate 304. The second conductive patch 303 is connected to a feeding point 308.

Third Embodiment

Figure 4A:
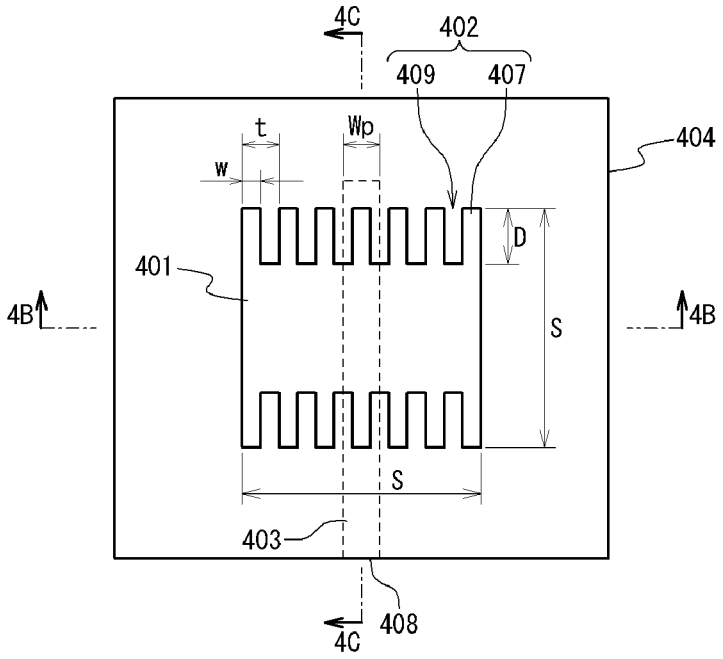
FIG. 4A is a top view of an antenna disposed in a multilayer substrate in which the first patch has corrugations with ridges directed in parallel to the longer side of the second patch.
Figure 4B:
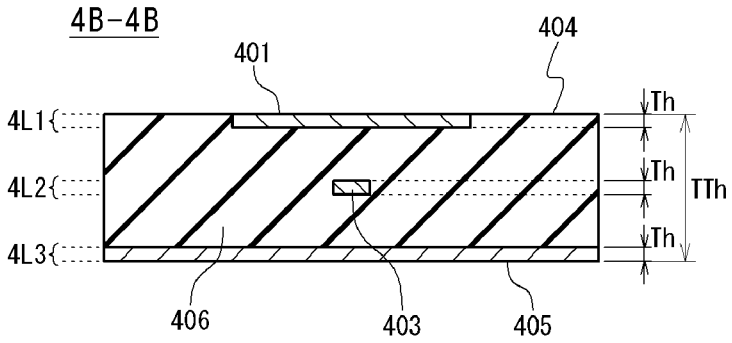
FIG. 4B is a vertical cross-sectional view of the antenna shown in FIG. 4A on the 4B section.
Figure 4C:
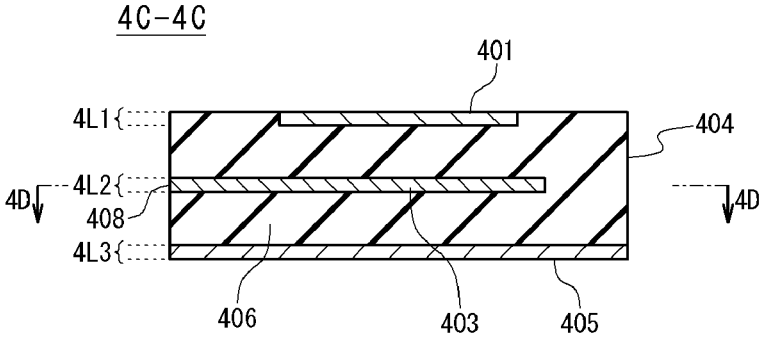
FIG. 4C is a vertical cross-sectional view of the antenna shown in FIG. 4A on the 4C section.
Figure 4D:
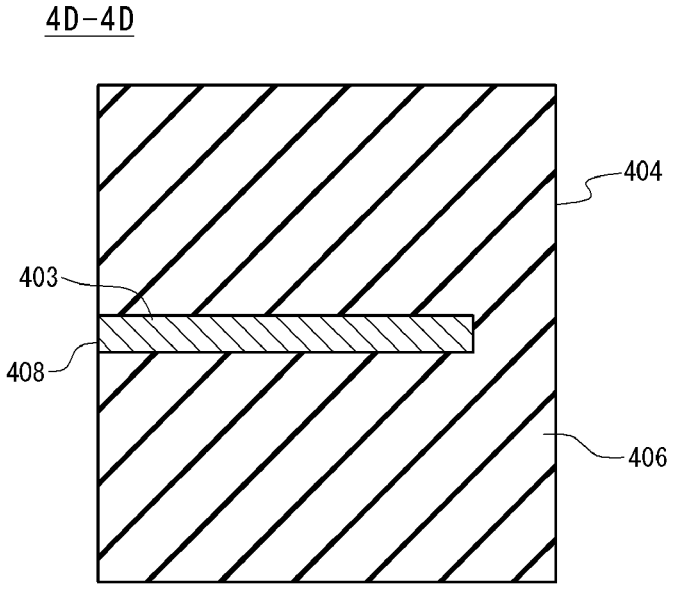
FIG. 4D is a horizontal cross-sectional view of the antenna shown in FIGS. 4B and 4C on the 4D section.

Another exemplary embodiment of the broadband patch antenna is presented in FIGS. 4A to 4D. FIG. 4A is a top view of this antenna. FIG. 4B is a vertical cross-sectional view of this antenna on the 4B section in FIG. 4A. FIG. 4C is a vertical cross-sectional view of this antenna on the 4C section in FIG. 4A. FIG. 4D is a horizontal cross-sectional view of this antenna on the 4D section in FIGS. 4B and 4C.

In this embodiment, the antenna shown in these figures is formed in a 3-conductor-layer substrate 404. The 3-conductor-layer substrate 404 includes a first conductive layer 4L1, a second conductive layer 4L2, a third conductive layer 4L3 and an isolating material 406.

The first conductive layer 4L1 includes a first conductive patch 401. The second conductive layer 4L2 includes a second conductive patch 403. The third conductive layer 4L3 includes a ground plane 405. The first conductive patch 401 has a square shape with corrugations 402 on two opposing sides. The corrugations 402 include rectangular ridges 407 and rectangular grooves 409. The second conductive patch 403 has a rectangular shape.

The second conductive layer 4L2 is disposed below the first conductive layer 4L1. The third conductive layer 4L3 is disposed below the second conductive layer 4L2. Consequently, the second conductive patch 403 is disposed below the first conductive patch 401, and the ground plane 405 is disposed below the second conductive patch 403. One end of the second conductive patch 403 is connected to a feeding point 408. The isolating material 406 is disposed between the first conductive patch 401 and the second conductive patch 403, and between the second patch 403 and the ground plane 405.

In this antenna, ridges 407 of the corrugations 402 are directed in parallel to the longer side of the second conductive patch 403. In such way, an enlargement of the bandwidth is provided.

Fourth Embodiment

Figure 5A:
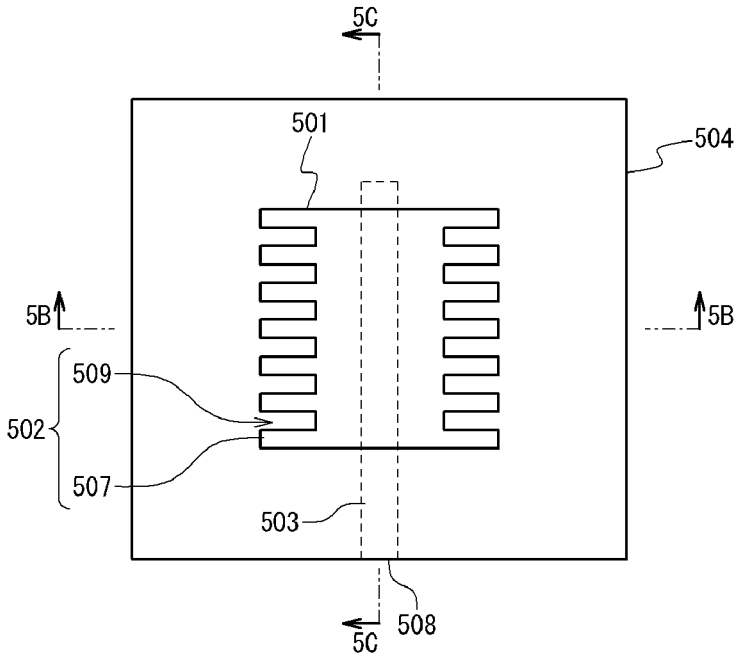
FIG. 5A is a top view of an antenna disposed in a multilayer substrate in which the first patch has corrugations with ridges directed perpendicularly to the longer side of the second patch.
Figure 5B:
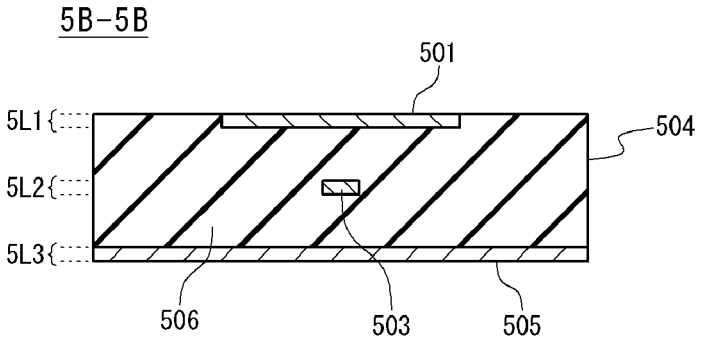
FIG. 5B is a vertical cross-sectional view of the antenna shown in FIG. 5A on the 5B section.
Figure 5C:
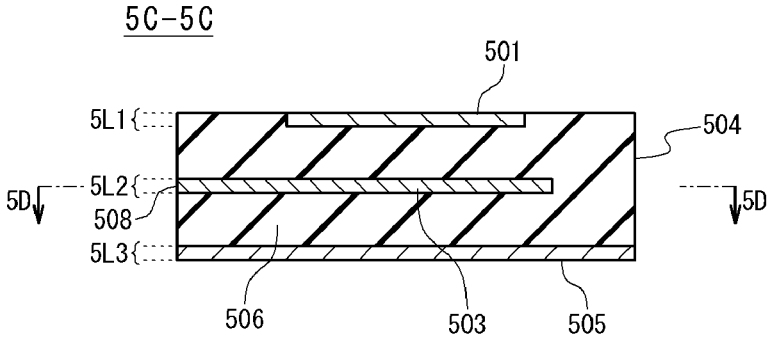
FIG. 5C is a vertical cross-sectional view of the antenna shown in FIG. 5A on the 5C section.
Figure 5D:
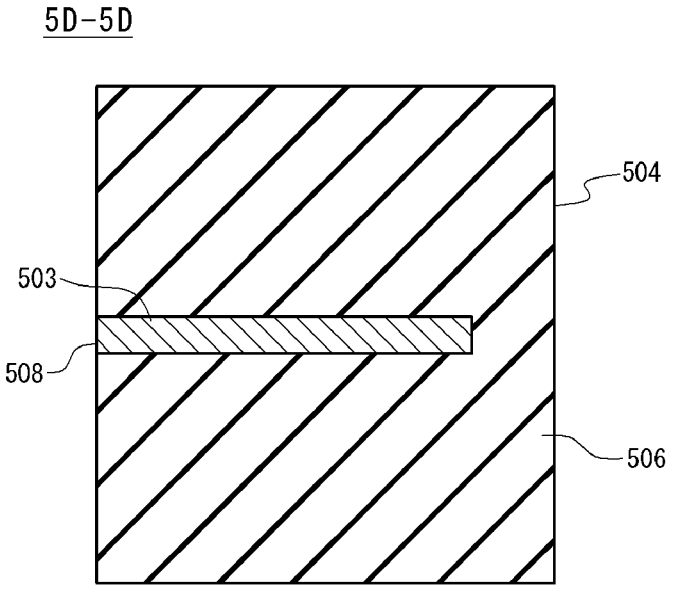
FIG. 5D is a horizontal cross-sectional view of the antenna shown in FIGS. 5B and 5C on the 5D section.

In FIGS. 5A to 5D, another exemplary embodiment of the broadband patch antenna is given. FIG. 5A is a top view of this antenna. FIG. 5B is a vertical cross-sectional view of this antenna on the 5B section in FIG. 5A. FIG. 5C is a vertical cross-sectional view of this antenna on the 5C section in FIG. 5A. FIG. 5D is a horizontal cross-sectional view of this antenna on the 5D section in FIGS. 5B and 5C.

In this embodiment, the antenna shown in these figure is formed in a 3-conductor-layer substrate 504. The 3-conductor-layer substrate 504 includes a first conductive layer 5L1, a second conductive layer 5L2, a third conductive layer 5L3 and an isolating material 506.

The first conductive layer 5L1 includes a first conductive patch 501. The second conductive layer 5L2 includes a second conductive patch 503. The third conductive layer 5L3 includes a ground plane 505. The first conductive patch 501 has a square shape with corrugations 502 on two opposing sides. The corrugations 502 include rectangular ridges 507 and rectangular grooves 509. The second conductive patch 503 has a rectangular shape.

The second conductive layer 5L2 is disposed below the first conductive layer 5L1. The third conductive layer 5L3 is disposed below the second conductive layer 5L2. Consequently, the second conductive patch 503 is disposed below the first conductive patch 501, and the ground plane 505 is disposed below the second conductive patch 503. One end of the second conductive patch 503 is connected to a feeding point 508. The isolating material 506 is disposed between the first conductive patch 501 and the second conductive patch 503, and between the second patch 503 and the ground plane 505.

In this antenna, ridges 507 of the corrugations 502 are directed perpendicularly to the longer side of the second conductive patch 503.

To show an effect of corrugations on the bandwidth, the return loss (|S11|-parameter) was simulated for an invented patch antenna and a relating art patch antenna by the Finite-Difference Time-Domain (FDTD) technique, which is one of the most widely-used methods.

The invented patch antenna considered is similar to that shown in FIGS. 4A-4D. Characteristics parameters of this antenna are as following: the side S of the first conductive patch 401 having a square form is 0.75 mm; the width Wp of the second conductive patch 403 is 0.08 mm; the total thickness TTh of the substrate 404 is 0.53 mm; and the thickness Th of the first, second and third conductive layers 4L1, 4L2 and 4L3 is 0.01 mm each. As isolating material 406, the LTCC (Low Temperature Co-firing Ceramic) with relative permittivity of 5.3 and loss tangent of 0.004 is used. In the simulated antenna, the corrugations have such dimensions: the width w of the ridges 407 is 0.05 mm; the pitch t of the corrugations 402 is 0.1 mm; and the depth D of the grooves 409 is 0.18 mm.

Figure 6:
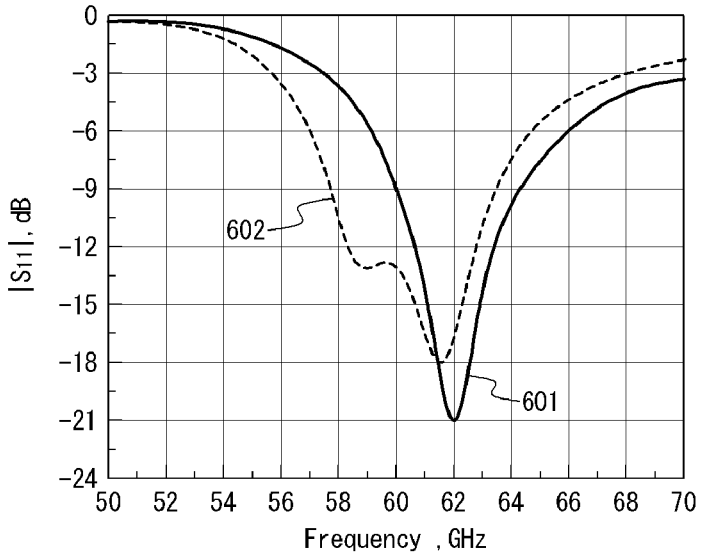
FIG. 6 is a group of graphs showing an effect of the corrugations at the patch edges on the bandwidth shown by means of simulated return losses.

In FIG. 6, a group of two graphs is shown. The first graph 601 shows a numerical result of the case when the patch antenna is obtained with smooth sided patch without application of corrugations, similar to the related art patch antenna shown in FIG. 3. The second graph 602 shows a simulated data for the above mentioned antenna with corrugated patch similar to FIGS. 4A to 4D.

As one can see, the antenna with corrugated patch has considerably wider bandwidth compared with the antenna with smooth sided patch.

Figure 7:
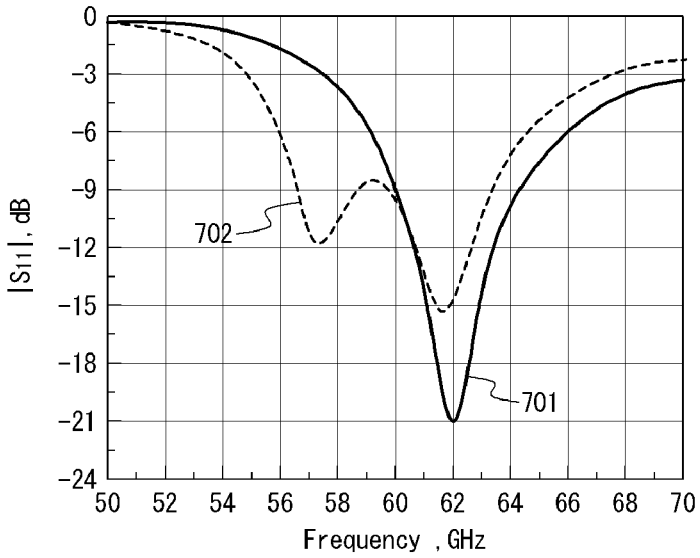
FIG. 7 is a group of graphs showing an effect of the corrugations at the patch edges on the bandwidth shown by means of simulated return losses.

It should be noted that the corrugation depth D is an effective parameter to control the bandwidth of the patch antenna of the present invention. In FIG. 7, a group of two graphs is shown. The first graph 701 is identical to the first graph 601 in FIG. 6. The second graph 702 shows a simulated data for the patch antenna with corrugations having the depth D of 0.22 mm. In this antenna, other dimensions are the same as in FIG. 6. Thus, an increase of the corrugation depth, as follows from this figure, can lead to widening the bandwidth of the patch antenna.

Fifth Embodiment

Figure 8:
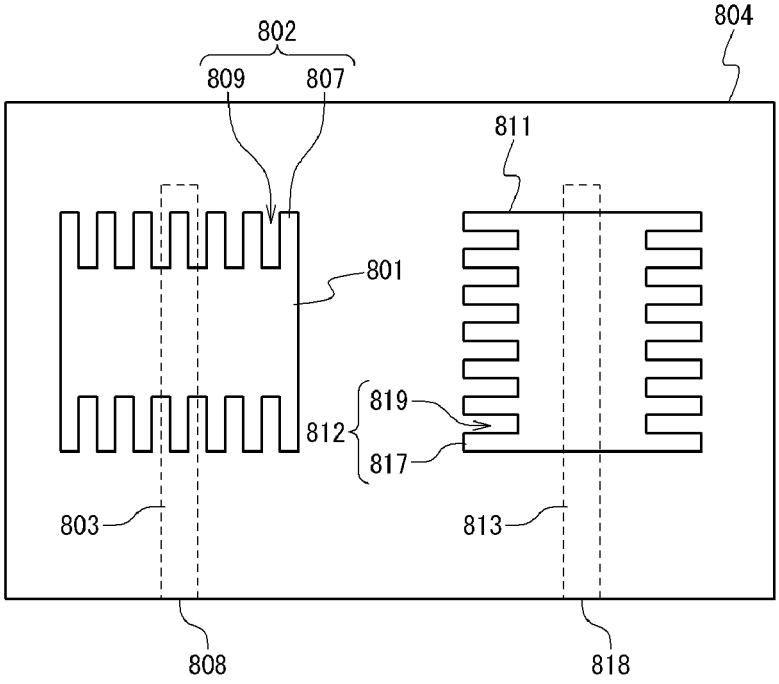
FIG. 8 is a top view of an antenna comprising two elements in which the first element has the first patch with corrugations directed in parallel to the longer side of the second patch, and the second element has the first patch with corrugations oriented perpendicularly to the longer side of the second patch.

Invented broad patch antennas can be used as elements to form an antenna array. In FIG. 8, an exemplary embodiment of an antenna array of the present invention is shown. This antenna array is an arrangement of two antenna elements formed in a multilayer substrate 804.

A first antenna element of the antenna array shown in FIG. 8 is similar to the antenna shown in FIGS. 4A to 4D. The first antenna element includes: a first conductive patch 801 and a second conductive patch 803. The first conductive patch 801 has a rectangular shape with corrugations 802 on two opposing sides. The corrugations 802 include rectangular ridges 807 and rectangular grooves 809. One end of the second conductive patch 803 is connected to a feeding point 808. Other properties, dispositions and relationship of the first conductive patch 801, the second conductive patch 803, the corrugations 802, the ridges 807, the grooves 809 and the feeding point 808 shown in FIG. 8 are similar to those of the first conductive patch 401, the second conductive patch 403, the corrugations 402, the ridges 407, the grooves 409 and the feeding point 408 shown in FIG. 4, respectively.

A second antenna element of the antenna array shown in FIG. 8 is similar to the antenna shown in FIGS. 5A to 5D. The second antenna element includes: a first conductive patch 811 and a second conductive patch 813. The first conductive patch 811 has a rectangular shape with corrugations 812 on two opposing sides. The corrugations 812 include rectangular ridges 817 and rectangular grooves 819. One end of the second conductive patch 813 is connected to a feeding point 818. Other properties, dispositions and relationship of the first conductive patch 811, the second conductive patch 813, the corrugations 812, the ridges 817, the grooves 819 and the feeding point 818 shown in FIG. 8 are similar to those of the first conductive patch 501, the second conductive patch 503, the corrugations 502, the ridges 507, the grooves 509 and the feeding point 508 shown in FIG. 5, respectively.

The second conductive patches 803 and 813 are disposed in parallel. In the first element, ridges of corrugations 802 are directed in parallel to the longer side of the second conductive patch 803, while in the second element, the ridges of corrugations 812 are orientated perpendicularly to the longer side of the second conductive patch 813. It should be emphasized that the antenna array presented in FIG. 8 is especially useful to obtain circular or elliptical polarization of the radiated field.

Sixth Embodiment

Figure 9:
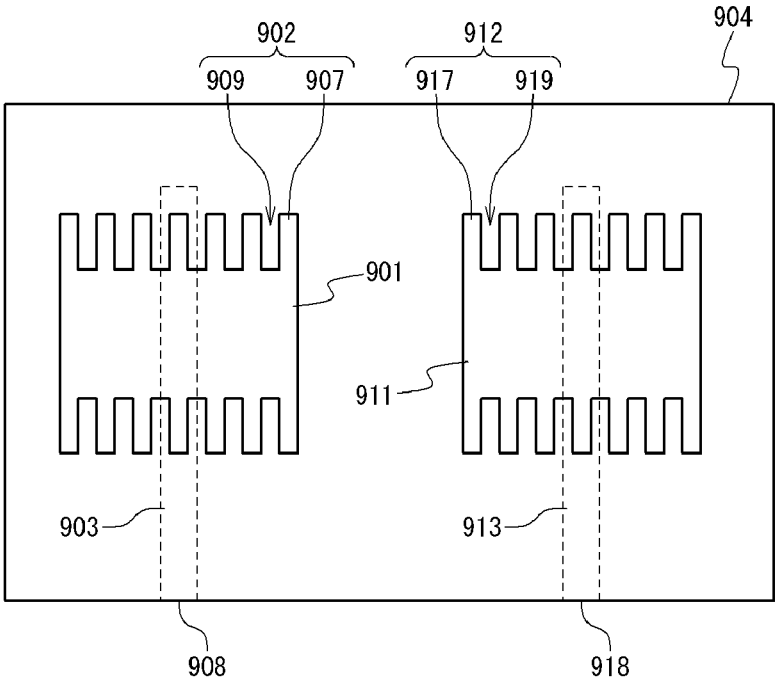
FIG. 9 is a top view of an antenna comprising two elements in which the first element has the first patch with corrugations directed in parallel to the longer side of the second patch, and the second element has the first patch with corrugations oriented also in parallel to the longer side of the second patch.

Another exemplary embodiment of the antenna array is presented in FIG. 9. This antenna array is an arrangement of two antenna elements formed in a multilayer substrate 904.

Both a first antenna element and a second antenna element of the antenna array shown in FIG. 9 are similar to the antenna shown in FIGS. 4A to 4D. The first antenna element includes: a first conductive patch 901 and a second conductive patch 903. The first conductive patch 901 has a rectangular shape with corrugations 902 on two opposing sides. The corrugations 902 include rectangular ridges 907 and rectangular grooves 909. One end of the second conductive patch 903 is connected to a feeding point 908. Other properties, dispositions and relationship of the first conductive patch 901, the second conductive patch 903, the corrugations 902, the ridges 907, the grooves 909 and the feeding point 908 shown in FIG. 9 are similar to those of the first conductive patch 401, the second conductive patch 403, the corrugations 402, the ridges 407, the grooves 409 and the feeding point 408 shown in FIG. 4, respectively.

The second antenna element includes: a first conductive patch 911 and a second conductive patch 913. The first conductive patch 911 has a rectangular shape with corrugations 912 on two opposing sides. The corrugations 912 include rectangular ridges 917 and rectangular grooves 919. One end of the second conductive patch 913 is connected to a feeding point 918. Other properties, dispositions and relationship of the first conductive patch 911, the second conductive patch 913, the corrugations 912, the ridges 917, the grooves 919 and the feeding point 918 shown in FIG. 9 are similar to those of the first conductive patch 401, the second conductive patch 403, the corrugations 402, the ridges 407, the grooves 409 and the feeding point 408 shown in FIG. 4, respectively.

The second conductive patches 903 and 913 are disposed in parallel. In the first and second antenna elements, ridges 907 and 917 of corrugations 902 and 912 are oriented in parallel to the longer side of the second conductive patches 903 and 913.

Seventh Embodiment

Figure 10:
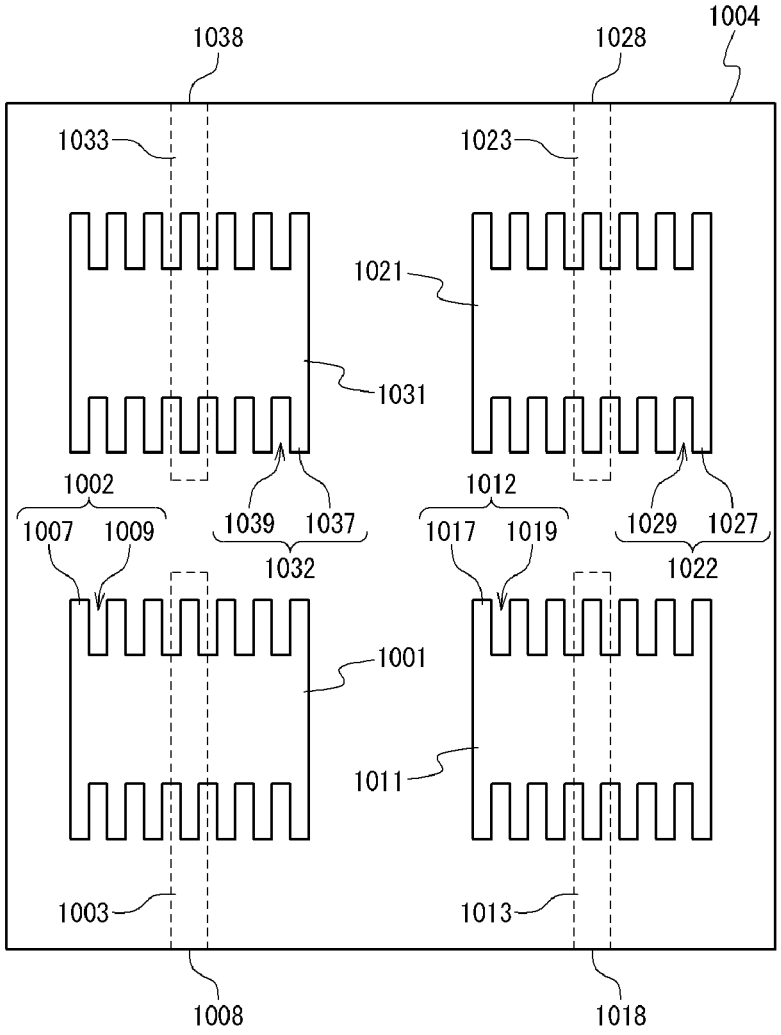
FIG. 10 is a top view of an antenna array comprising four elements in which the first patches have corrugations with ridges oriented in parallel to the longer side of the second patches.

It should be well understandable that a number of antenna elements forming an antenna array can be different. In FIG. 10, an exemplary embodiment of an antenna array with four antenna elements is shown. Those four antenna elements are formed in a multilayer substrate 1004.

Each of the four antenna element of the antenna array shown in FIG. 10 is similar to the antenna shown in FIGS. 4A to 4D. The first antenna element includes: a first conductive patch 1001 and a second conductive patch 1003. The first conductive patch 1001 has a rectangular shape with corrugations 1002 on two opposing sides. The corrugations 1002 include rectangular ridges 1007 and rectangular grooves 1009. One end of the second conductive patch 1003 is connected to a feeding point 1008. Other properties, dispositions and relationship of the first conductive patch 1001, the second conductive patch 1003, the corrugations 1002, the ridges 1007, the grooves 1009 and the feeding point 1008 shown in FIG. 10 are similar to those of the first conductive patch 401, the second conductive patch 403, the corrugations 402, the ridges 407, the grooves 409 and the feeding point 408 shown in FIG. 4, respectively.

The second antenna element includes: a first conductive patch 1011 and a second conductive patch 1013. The first conductive patch 1011 has a rectangular shape with corrugations 1012 on two opposing sides. The corrugations 1012 include rectangular ridges 1017 and rectangular grooves 1019. One end of the second conductive patch 1013 is connected to a feeding point 1018. Other properties, dispositions and relationship of the first conductive patch 1011, the second conductive patch 1013, the corrugations 1012, the ridges 1017, the grooves 1019 and the feeding point 1018 shown in FIG. 10 are similar to those of the first conductive patch 401, the second conductive patch 403, the corrugations 402, the ridges 407, the grooves 409 and the feeding point 408 shown in FIG. 4, respectively.

The third antenna element includes: a first conductive patch 1021 and a second conductive patch 1023. The first conductive patch 1021 has a rectangular shape with corrugations 1022 on two opposing sides. The corrugations 1022 include rectangular ridges 1027 and rectangular grooves 1029. One end of the second conductive patch 1023 is connected to a feeding point 1028. Other properties, dispositions and relationship of the first conductive patch 1021, the second conductive patch 1023, the corrugations 1022, the ridges 1027, the grooves 1029 and the feeding point 1028 shown in FIG. 10 are similar to those of the first conductive patch 401, the second conductive patch 403, the corrugations 402, the ridges 407, the grooves 409 and the feeding point 408 shown in FIG. 4, respectively.

The fourth antenna element includes: a first conductive patch 1031 and a second conductive patch 1033. The first conductive patch 1031 has a rectangular shape with corrugations 1032 on two opposing sides. The corrugations 1032 include rectangular ridges 1037 and rectangular grooves 1039. One end of the second conductive patch 1033 is connected to a feeding point 1038. Other properties, dispositions and relationship of the first conductive patch 1031, the second conductive patch 1033, the corrugations 1032, the ridges 1037, the grooves 1039 and the feeding point 1038 shown in FIG. 10 are similar to those of the first conductive patch 401, the second conductive patch 403, the corrugations 402, the ridges 407, the grooves 409 and the feeding point 408 shown in FIG. 4, respectively.

The second conductive patches 1003, 1013, 1023 and 1033 are disposed in parallel. The second conductive patches 1003 and 1033 are aligned in opposite direction. The second conductive patches 1013 and 1023 are aligned in opposite direction. The first conductive patches 1001, 1011, 1021 and 1031 are disposed in such way that their centers are arranged on each corner of a rectangle or a square. Ridges 1007, 1017, 1027 and 1037 of the corrugations 1002, 1012, 1022 and 1032 in these antenna elements are oriented in parallel to the longer side of the second conductive patches 1003, 1013, 1023 and 1033, respectively.

Eighth Embodiment

Figure 11:
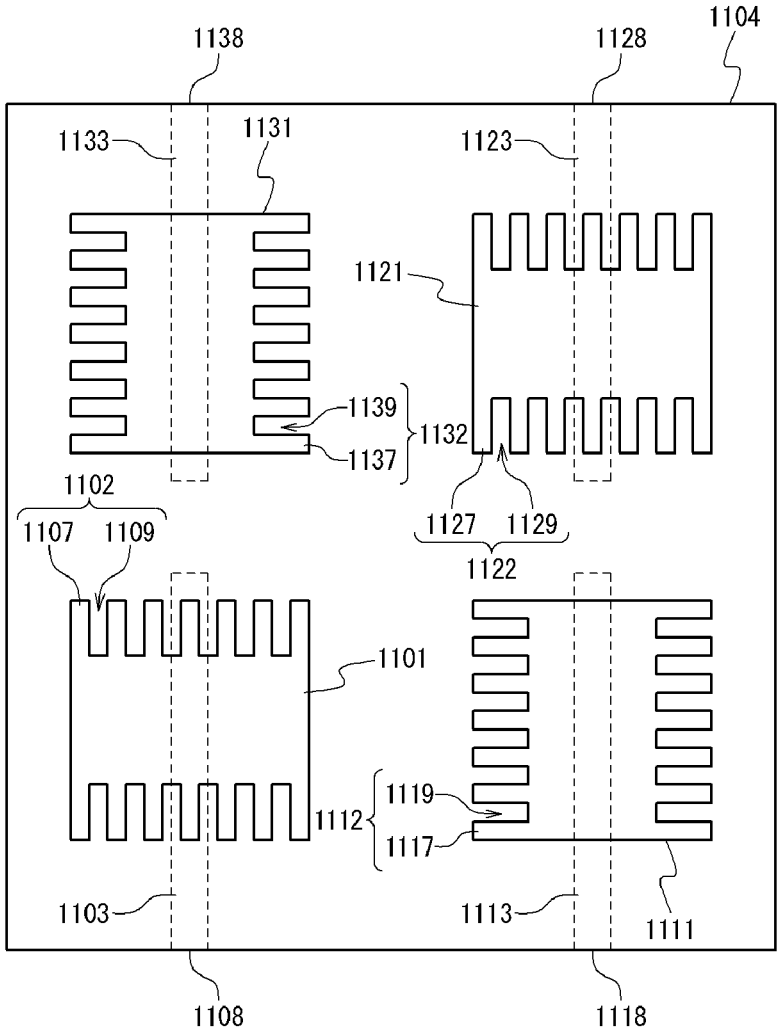
FIG. 11 is a top view of an antenna array comprising four elements in which the first patches have corrugations with ridges oriented both in parallel and perpendicularly to the longer side of the second patches.

Another exemplary embodiment of the antenna array with four antenna elements is shown in FIG. 11. In this embodiment, those four elements are disposed in a multilayer substrate 1104.

A first antenna element of the antenna array shown in FIG. 11 is similar to the antenna shown in FIGS. 4A to 4D. The first antenna element includes: a first conductive patch 1101 and a second conductive patch 1103. The first conductive patch 1101 has a rectangular shape with corrugations 1102 on two opposing sides. The corrugations 1102 include rectangular ridges 1107 and rectangular grooves 1109. One end of the second conductive patch 1103 is connected to a feeding point 1108. Other properties, dispositions and relationship of the first conductive patch 1101, the second conductive patch 1103, the corrugations 1102, the ridges 1107, the grooves 1109 and the feeding point 1108 shown in FIG. 11 are similar to those of the first conductive patch 401, the second conductive patch 403, the corrugations 402, the ridges 407, the grooves 409 and the feeding point 408 shown in FIG. 4, respectively.

A second antenna element of the antenna array shown in FIG. 11 is similar to the antenna shown in FIGS. 5A to 5D. The second antenna element includes: a first conductive patch 1111 and a second conductive patch 1113. The first conductive patch 1111 has a rectangular shape with corrugations 1112 on two opposing sides. The corrugations 1112 include rectangular ridges 1117 and rectangular grooves 1119. One end of the second conductive patch 1113 is connected to a feeding point 1118. Other properties, dispositions and relationship of the first conductive patch 1111, the second conductive patch 1113, the corrugations 1112, the ridges 1117, the grooves 1119 and the feeding point 1118 shown in FIG. 11 are similar to those of the first conductive patch 501, the second conductive patch 503, the corrugations 502, the ridges 507, the grooves 509 and the feeding point 508 shown in FIG. 5, respectively.

A third antenna element of the antenna array shown in FIG. 11 is similar to the antenna shown in FIGS. 4A to 4D. The third antenna element includes: a first conductive patch 1121 and a second conductive patch 1123. The first conductive patch 1121 has a rectangular shape with corrugations 1122 on two opposing sides. The corrugations 1122 include rectangular ridges 1127 and rectangular grooves 1129. One end of the second conductive patch 1123 is connected to a feeding point 1128. Other properties, dispositions and relationship of the first conductive patch 1121, the second conductive patch 1123, the corrugations 1122, the ridges 1127, the grooves 1129 and the feeding point 1128 shown in FIG. 11 are similar to those of the first conductive patch 401, the second conductive patch 403, the corrugations 402, the ridges 407, the grooves 409 and the feeding point 408 shown in FIG. 4, respectively.

A fourth antenna element of the antenna array shown in FIG. 11 is similar to the antenna shown in FIGS. 5A to 5D. The fourth antenna element includes: a first conductive patch 1131 and a second conductive patch 1133. The first conductive patch 1131 has a rectangular shape with corrugations 1132 on two opposing sides. The corrugations 1132 include rectangular ridges 1137 and rectangular grooves 1139. One end of the second conductive patch 1133 is connected to a feeding point 1138. Other properties, dispositions and relationship of the first conductive patch 1131, the second conductive patch 1133, the corrugations 1132, the ridges 1137, the grooves 1139 and the feeding point 1138 shown in FIG. 11 are similar to those of the first conductive patch 501, the second conductive patch 503, the corrugations 502, the ridges 507, the grooves 509 and the feeding point 508 shown in FIG. 5, respectively.

The second conductive patches 1103, 1113, 1123 and 1133 are disposed in parallel. The second conductive patches 1103 and 1133 are aligned in opposite direction. The second conductive patches 1113 and 1123 are aligned in opposite direction. The first conductive patches 1101, 1111, 1121 and 1131 are disposed in such way that their centers are arranged on each corner of a rectangle or a square.

It should be noted that ridges 1107 and 1127 of the corrugations 1102 and 1122 are directed in parallel to the longer side of the second rectangular conductive patches 1103 and 1123, respectively, while ridges 1117 and 1137 of the corrugations 1112 and 1132 are oriented perpendicularly to the longer side of the second rectangular conductive patches 1113 and 1133, respectively. Such arrangement of antenna elements can be applied to obtain circular or elliptical polarization of radiation field.

Ninth Embodiment

Figure 12:
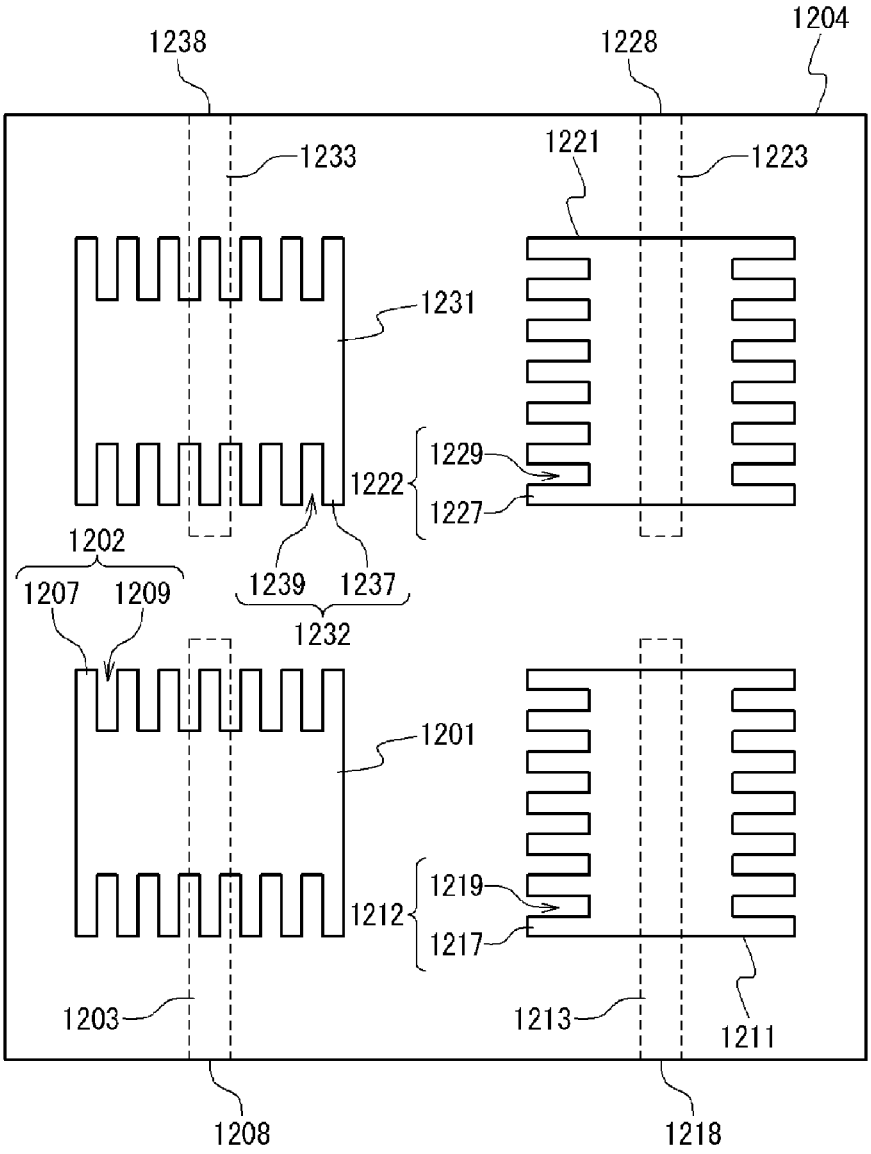
FIG. 12 is a top view of an antenna array comprising four elements in which the first patches have corrugations with ridges oriented both in parallel and perpendicularly to the longer side of the second patches.

In FIG. 12, another exemplary embodiment of the antenna array with four antenna elements is presented. In this embodiment, those four antenna elements are disposed in a multilayer substrate 1204.

A first antenna element of the antenna array shown in FIG. 12 is similar to the antenna shown in FIGS. 4A to 4D. The first antenna element includes: a first conductive patch 1201 and a second conductive patch 1203. The first conductive patch 1201 has a rectangular shape with corrugations 1202 on two opposing sides. The corrugations 1202 include rectangular ridges 1207 and rectangular grooves 1209. One end of the second conductive patch 1203 is connected to a feeding point 1208. Other properties, dispositions and relationship of the first conductive patch 1201, the second conductive patch 1203, the corrugations 1202, the ridges 1207, the grooves 1209 and the feeding point 1208 shown in FIG. 12 are similar to those of the first conductive patch 401, the second conductive patch 403, the corrugations 402, the ridges 407, the grooves 409 and the feeding point 408 shown in FIG. 4, respectively.

A second antenna element of the antenna array shown in FIG. 12 is similar to the antenna shown in FIGS. 5A to 5D. The second antenna element includes: a first conductive patch 1211 and a second conductive patch 1213. The first conductive patch 1211 has a rectangular shape with corrugations 1212 on two opposing sides. The corrugations 1212 include rectangular ridges 1217 and rectangular grooves 1219. One end of the second conductive patch 1213 is connected to a feeding point 1218. Other properties, dispositions and relationship of the first conductive patch 1211, the second conductive patch 1213, the corrugations 1212, the ridges 1217, the grooves 1219 and the feeding point 1218 shown in FIG. 12 are similar to those of the first conductive patch 501, the second conductive patch 503, the corrugations 502, the ridges 507, the grooves 509 and the feeding point 508 shown in FIG. 5, respectively.

A third antenna element of the antenna array shown in FIG. 12 is similar to the antenna shown in FIGS. 5A to 5D. The third antenna element includes: a first conductive patch 1221 and a second conductive patch 1223. The first conductive patch 1221 has a rectangular shape with corrugations 1222 on two opposing sides. The corrugations 1222 include rectangular ridges 1227 and rectangular grooves 1229. One end of the second conductive patch 1223 is connected to a feeding point 1228. Other properties, dispositions and relationship of the first conductive patch 1221, the second conductive patch 1223, the corrugations 1222, the ridges 1227, the grooves 1229 and the feeding point 1228 shown in FIG. 12 are similar to those of the first conductive patch 501, the second conductive patch 503, the corrugations 502, the ridges 507, the grooves 509 and the feeding point 508 shown in FIG. 5, respectively.

A fourth antenna element of the antenna array shown in FIG. 12 is similar to the antenna shown in FIGS. 4A to 4D. The fourth antenna element includes: a first conductive patch 1231 and a second conductive patch 1233. The first conductive patch 1231 has a rectangular shape with corrugations 1232 on two opposing sides. The corrugations 1232 include rectangular ridges 1237 and rectangular grooves 1239. One end of the second conductive patch 1233 is connected to a feeding point 1238. Other properties, dispositions and relationship of the first conductive patch 1231, the second conductive patch 1233, the corrugations 1232, the ridges 1237, the grooves 1239 and the feeding point 1238 shown in FIG. 12 are similar to those of the first conductive patch 401, the second conductive patch 403, the corrugations 402, the ridges 407, the grooves 409 and the feeding point 408 shown in FIG. 4, respectively.

The second conductive patches 1203, 1213, 1223 and 1233 are disposed in parallel. The second conductive patches 1203 and 1233 are aligned in opposite direction. The second conductive patches 1213 and 1223 are aligned in opposite direction. The first conductive patches 1201, 1211, 1221 and 1231 are disposed in such way that their centers are arranged on each corner of a rectangle or a square.

In this exemplary embodiment, ridges 1207 and 1237 of the corrugations 1202 and 1232 are directed in parallel to the longer side of the second rectangular conductive patches 1203 and 1233, respectively, while ridges 1217 and 1227 of the corrugations 1212 and 1222 are oriented perpendicularly to the longer side of the second rectangular conductive patches 1213 and 1223, respectively. This distribution of antenna elements can be also used to obtain circular or elliptical polarization of radiation field.

While the present invention has been described in relation to some exemplary embodiments, it is to be understood that these exemplary embodiments are for the purpose of description by example, and not of limitation. While it will be obvious to those skilled in the art upon reading the present specification that various changes and substitutions may be easily made by similar components and art, it is obvious that such changes and substitutions lie within the true scope and spirit of the presented invention as defined by the claims.

What is claimed is:

1. An antenna comprising:

a ground plane;

a first conductive patch disposed in parallel to said ground plane and having a rectangular shape with corrugations on two opposing sides; and a second conductive patch disposed in parallel to both said ground plane and said first conductive path, disposed between said ground plane and said first conductive patch, and connected to a feeding point;

wherein said second conductive patch overcrosses said first conductive patch, and wherein said corrugations of said first conductive patch and said second conductive patch form a configuration providing a one-dimensional grid effect due to a predetermined orientation of the said corrugations in said first conductive patch and said second conductive patch, together with said overcrossing of said first conductive patch by said second conductive patch; and wherein said one-dimensional grid effect provides an extension of the operation band of said antenna.

2. The antenna according to claim 1, wherein said corrugations comprise:

rectangular ridges; and rectangular grooves.

3. The antenna according to claim 2, wherein said second conductive patch has a rectangular shape.

4. The antenna according to claim 3, wherein a longer side of said second conductive patch is in parallel to an orientation of said ridges providing said one-dimensional grid effect as an inductive one.

5. The antenna according to claim 3, wherein a longer side of said second conductive patch is perpendicular to an orientation of said ridges providing said one-dimensional grid effect as a capacitive one.

6. The antenna according to claim 3, further comprising:

a third conductive patch included in a first conductor layer in which said first conductive patch is included;

a fourth conductive patch included in a second conductor layer in which said second conductive patch is included; and an isolating material configured to isolate said first, said second, said third and said fourth conductive patches, wherein said first conductive patch has a square shape with said corrugations on said two opposing side, wherein said third conductive patch has a rectangular shape with corrugations on two opposing sides, wherein said corrugations comprise:

rectangular ridges; and rectangular grooves, and wherein said fourth conductive patch has a rectangular shape with a longer side disposed in parallel to a longer side of said second conductive patch and is connected to a feeding point.

7. The antenna according to claim 6, wherein said longer side of said second conductive patch is in parallel to an orientation of said ridges of said first conductive patch, and wherein said longer side of said fourth conductive patch is in parallel to an orientation of said ridges of said third conductive patch.

8. The antenna according to claim 6, wherein said longer side of said second conductive patch is in parallel to an orientation of said ridges of said first conductive patch, and wherein said longer side of said fourth conductive patch is perpendicular to an orientation of said ridges of said third conductive patch.

9. The antenna according to claim 7, further comprising:

a fifth conductive patch included in said first conductive layer;

a sixth conductive patch included in said second conductive layer;

a seventh conductive patch included in said first conductive layer; and an eighth conductive patch included in said second conductive layer, wherein said first, said second, said third, said fourth, said fifth, said sixth, said seventh and said eighth conductive patches are isolated from each other by said isolating material, wherein each of said fifth and said seventh conductive patches has a rectangular shape with corrugations on two opposing sides, wherein said corrugations comprise:

rectangular ridges; and rectangular grooves, wherein each of said sixth and said eighth conductive patches has a rectangular shape with a longer side disposed in parallel to said longer side of said second conductive patch and is connected to further a feeding point, and wherein said ridges of said fifth and said seventh conductive patches are disposed in parallel to said longer side of said sixth and said eighth conductive patch, respectively.

10. The antenna according to claim 8, further comprising:

a fifth conductive patch included in said first conductive layer;

a sixth conductive patch included in said second conductive layer;

a seventh conductive patch included in said first conductive layer; and an eighth conductive patch included in said second conductive layer, wherein said first, said second, said third, said fourth, said fifth, said sixth, said seventh and said eighth conductive patches are isolated from each other by said isolating material, wherein each of said fifth and said seventh conductive patches has a rectangular shape with corrugations on two opposing sides, wherein said corrugations comprise:

rectangular ridges; and rectangular grooves, wherein each of said sixth and said eighth conductive patches has a rectangular shape with a longer side disposed in parallel to said longer side of said second conductive patch and is connected to further a feeding point, wherein said ridges of said fifth conductive patch are disposed in parallel to said longer side of said sixth conductive patch, and wherein said ridges of said seventh conductive patches are disposed perpendicularly to said longer side of said eighth conductive patch.

* * * * *